US006979098B2

(12) United States Patent
Petzl et al.

(10) Patent No.: US 6,979,098 B2
(45) Date of Patent: Dec. 27, 2005

(54) PORTABLE ELECTRIC TORCH EQUIPPED WITH A SWIVELLING OPTIC SYSTEM

(75) Inventors: Paul Petzl, Barraux (FR); Sébastien Jarzac, Grenoble (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/736,596

(22) Filed: Dec. 17, 2003

(65) Prior Publication Data

US 2004/0156194 A1 Aug. 12, 2004

(30) Foreign Application Priority Data

Feb. 10, 2003 (FR) ..... 03 01533

(51) Int. Cl.[7] ..... F21L 19/00

(52) U.S. Cl. ..... 362/177; 362/167; 362/185; 362/186; 362/208; 362/800; 362/230; 362/235; 362/251; 362/277; 362/293; 362/311; 362/322

(58) Field of Search ..... 362/177, 166, 362/167, 164, 184, 185, 186, 208, 800, 230, 362/235, 251, 277, 293, 311, 322

(56) References Cited

U.S. PATENT DOCUMENTS

| | | | | |
|---|---|---|---|---|
| 2,389,591 | A * | 11/1945 | Brown | 362/205 |
| 3,843,878 | A | 10/1974 | Ueda et al. | |
| 5,490,050 | A | 2/1996 | Clark et al. | |
| 6,793,366 | B2 * | 9/2004 | Chun | 362/184 |

FOREIGN PATENT DOCUMENTS

| | | |
|---|---|---|
| DE | 2 026 691 | 12/1971 |

* cited by examiner

*Primary Examiner*—Sandra O'Shea
*Assistant Examiner*—Sharon Payne
(74) *Attorney, Agent, or Firm*—Oliff & Berridge, PLC

(57) ABSTRACT

A portable electric torch comprises a lighting module with light-emitting diodes, and optical transmission means mounted swivelling around a swivel pin securely fixed to the housing. The optical transmission means can be a colored filter or a lens able to be actuated with a limited swivelling movement between an inactive position away from the diodes and an active position situated facing the diodes. The swivel pin is horizontal being placed back from and under the diodes, and extends parallel to the direction of alignment of at least two diodes.

6 Claims, 2 Drawing Sheets

PORTABLE ELECTRIC TORCH EQUIPPED WITH A SWIVELLING OPTIC SYSTEM

BACKGROUND OF THE INVENTION

The invention relates to a portable electric torch comprising a lighting module with light-emitting diodes, a switch to control lighting of the diodes, and means for modifying the lighting beam emitted by the diodes through a window of the housing.

1. State of the Art

To obtain a torch with a colored light ray, it is state of the art to use light-emitting diodes having a predetermined color, or to equip the front face of the torch by means of a glass plate tinted with the required color.

This glass plate can be fitted fixedly without the possibility when using the torch of modifying the color of the light emitted by the torch.

The colored glass plate can also constitute an accessory able to be fitted onto the front face. Such an accessory is not integrated in the housing of the torch and may be misplaced or forgotten when used. Its fixing requires a manual fitting action, for example screwing on, engagement by press fitting or clip-fastening, which may be difficult to perform depending on the conditions of use. To return to the initial state of lighting with white light, the colored plate has to be removed and stored in a specific place so that it can easily be found later for a new change of lighting state.

2. Object of the Invention

One object of the invention consists in providing a portable electric torch with light-emitting diodes enabling the user to easily change the coloring of the lighting beam.

Another object of the invention consists in providing a portable electric torch with light-emitting diodes enabling the user to vary the lighting angle of the light beam.

The torch according to the invention comprises optical transmission means mounted swivelling around a swivel pin securely fixed to the housing, allowing a limited swivelling movement between an inactive position away from the diodes and an active position situated facing the diodes, the swivel pin extending substantially parallel to the direction of alignment of at least two diodes.

According to a preferred embodiment of the invention, the swivel pin of the optical transmission means is horizontal being placed back from and under the diodes. The optical transmission means simply have to be lifted to position them in front of the diodes in the active position. The longitudinal dimension of the torch remains unchanged in this position, as the optical transmission means are totally integrated in the window of the housing. The optical transmission means simply have to be lowered to return to the inactive position.

The optical transmission means can be formed by a colored filter or a suitable lens.

The front face of the housing preferably comprises a rim acting as bearing surface for the filter or lens in the inactive position.

The filter or lens is preferably L-shaped, being provided with a gripping finger at the top part, and with a cylindrical protuberance at the bottom part constituting said swivel pin.

It is also possible to locate the swivel pin of the optical transmission means above the diodes.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
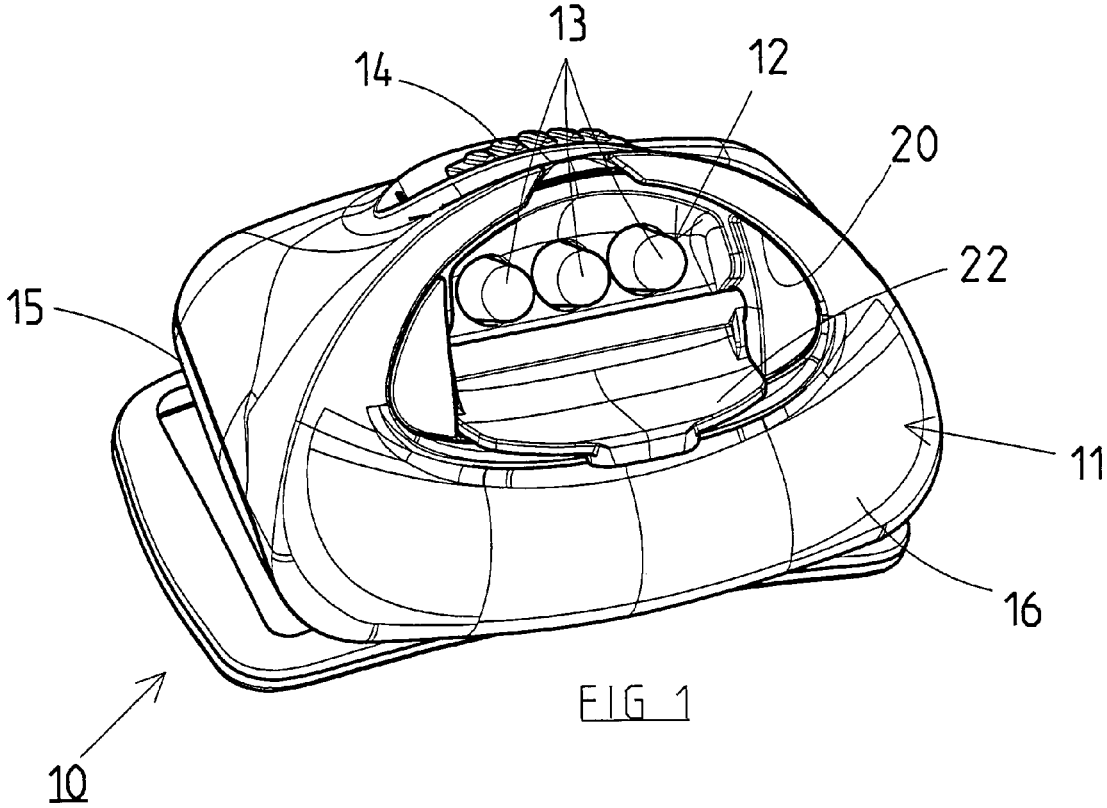
FIGS. 1 and 2 are perspective views of the torch equipped with the filter according to the invention, respectively in the inactive position and in the active position.

With reference to FIGS. 1 to 4, a portable electric torch 10, in particular a miner's lamp, comprises a housing 11 made of molded plastic material containing a lighting module 12 with light-emitting diodes 13, a power supply source (not represented) with throwaway or rechargeable batteries, and a switch 14 to control lighting of the diodes 13.

The housing 11 is composed of a back plate 15, a front enclosure 16, and an intermediate wall 17 subdividing the inside of the housing 11 into a first compartment 18 for housing the diodes 13, and a second compartment 19 for the power supply. The back plate 15 is assembled to the enclosure 16 by clip-fastening or by any other fixing means.

The front face of the enclosure 16 is provided with a front window 20 allowing the light beam emitted by the diodes 13 to pass through, and with a rim 21 salient towards the outside of the front face.

The lighting module 12 is for example equipped with three diodes 13 aligned horizontally in the window 20 of the first compartment 18. It is naturally possible to modify the arrangement and number of diodes 13.

Figure 2:
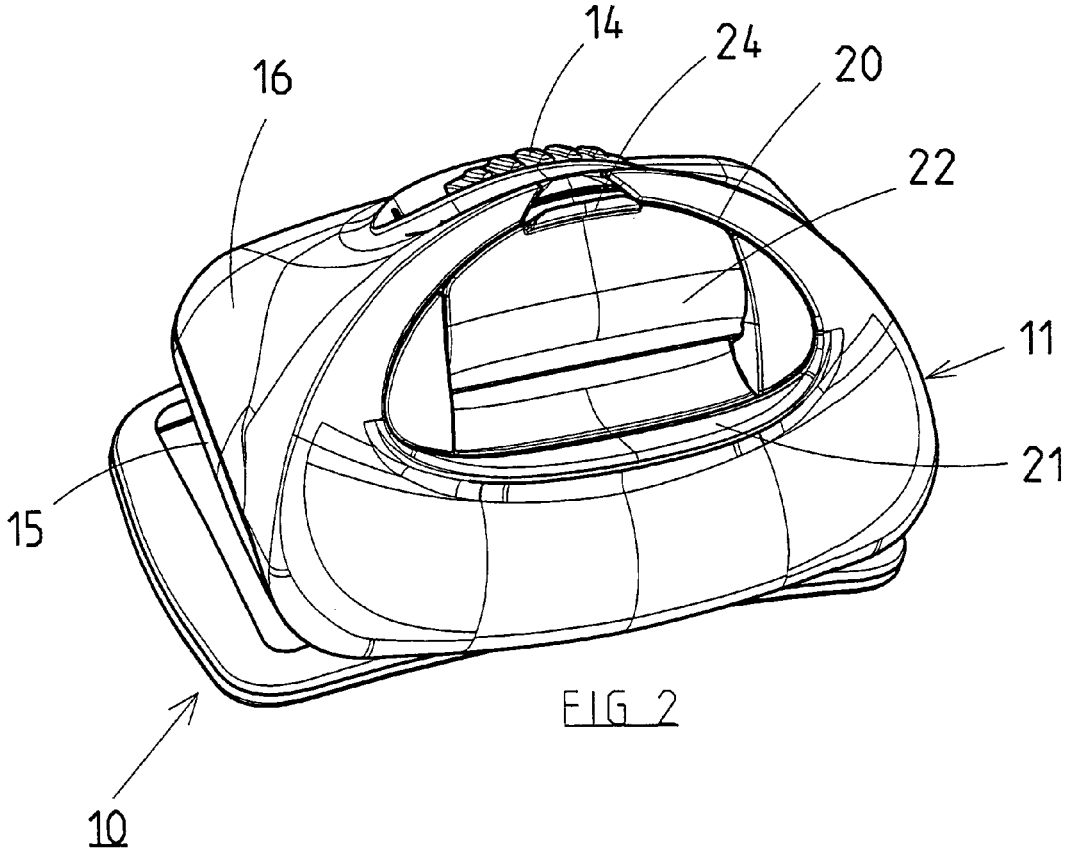
Figure 3:
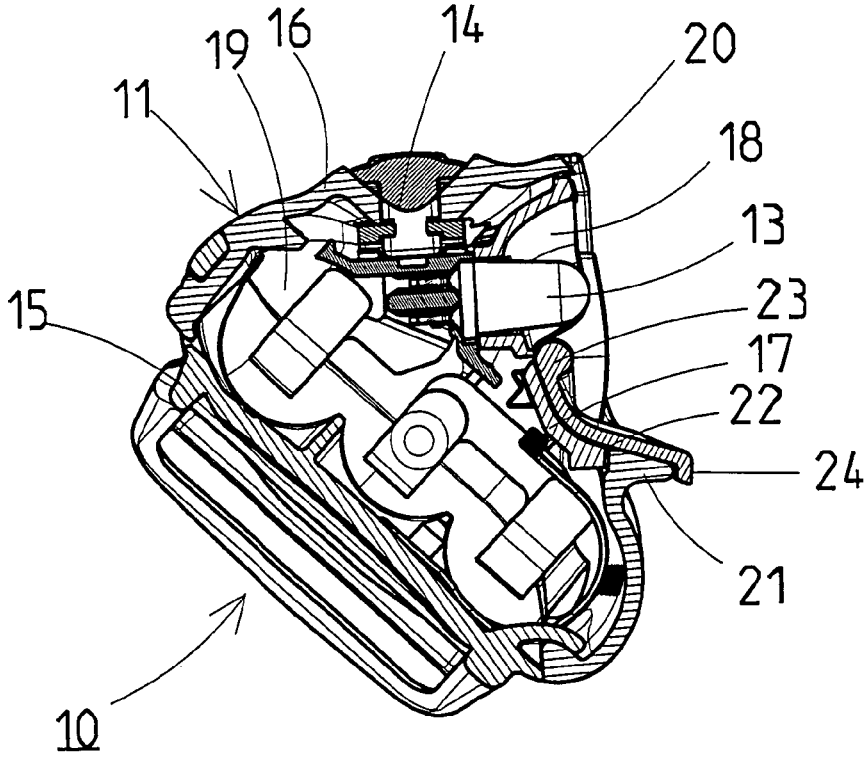
FIG. 3 is a vertical cross-sectional view of FIG. 1.
Figure 4:
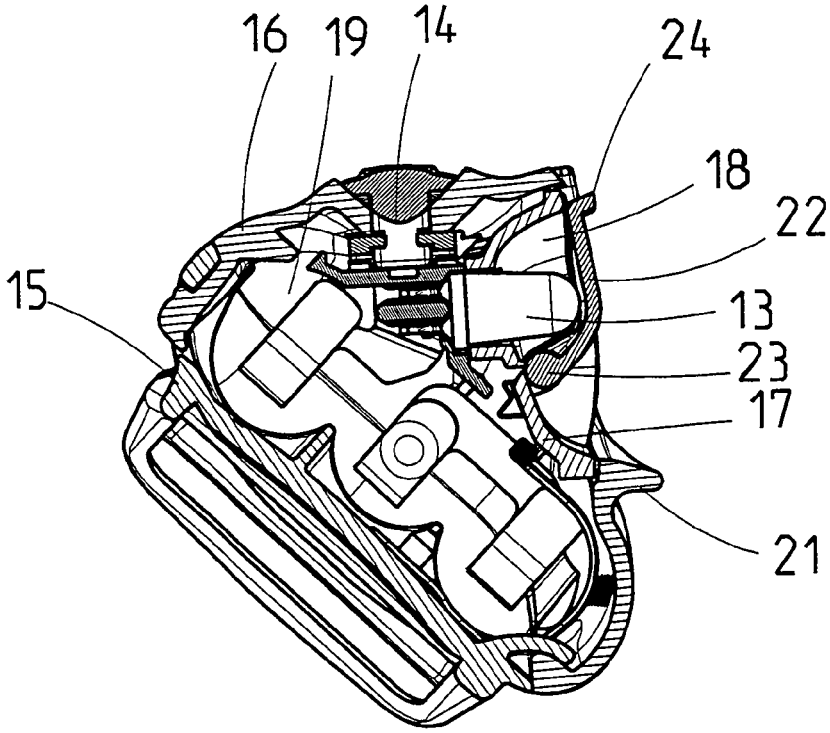
FIG. 4 is a vertical cross-sectional view of FIG. 2.

Optical transmission means comprise a colored filter 22 mounted swivelling around a horizontal swivel pin 23 to allow a limited swivelling movement between an inactive position (FIGS. 1 and 3) and an active position (FIGS. 2 and 4). The bottom end of the filter 22 is provided with a cylindrical protuberance constituting said swivel pin 23 guided in rotation in bearings of the intermediate wall 17. The top end of the filter 22 is equipped with a gripping finger 24 facilitating the swivelling movement from the inactive position to the active position, and vice-versa.

The horizontal swivel pin 23 of the filter 22 extends in a direction substantially parallel to the alignment axis of at least two diodes 13, and is advantageously placed back from and under the diodes 13.

The filter 22 is made of transparent plastic material containing pigmentation agents corresponding to the required coloring.

In the inactive position of FIGS. 1 and 3, the filter 22 presses on the rim 21 of the enclosure 16, and the diodes 13 emit a light beam of white color when the switch 14 is in the closed state. The first compartment 18 is open, as there is no glass plate in front of the diodes 13.

Swivelling the filter 22 from the lowered inactive position to the raised active position (FIGS. 2 and 4) blanks off the first compartment 18 as the filter 22 is engaged against the edges of the window 20. The laid back positioning of the swivel pin 23 enables the filter 22 to be placed at a small distance from the diodes 13 and to be totally integrated in the window 20 without being salient from the front face of the enclosure 16. The coloring of the lighting beam is modified after passing through the filter 22. In the example of a red filter 22, the beam becomes red.

According to an alternative embodiment, the optical transmission means can be formed by a lens, for example a Fresnel lens, designed to vary the lighting angle depending on whether it is in the active position or in the inactive position.

What is claimed is:

1. A portable electric torch, comprising:

a lighting module with light-emitting diodes, at least two diodes being arranged along a first direction that is substantially perpendicular to an optical axis of each of the diodes;

a switch to control lighting of the diodes; and optical transmission means for modifying a light beam emitted by the diodes through a window of a housing, the optical transmission means being mounted swivelling around a swivel pin securely fixed to the housing allowing a limited swivelling movement between an inactive position away from the diodes and an active position situated facing the diodes, the swivel pin extending in a second direction that is substantially parallel to the first direction of arrangement of the at least two diodes, being arranged under the diodes, and being located from the window at a fixed distance that is larger than a distance from the diodes to the window, the swivel pin remaining at the fixed distance when the optical transmission means is in the active position and the inactive position.

2. The portable electric torch according to claim 1, wherein the front face of the housing comprises a rim acting as bearing surface for the optical transmission means when the optical transmission means are in the inactive position.

3. The portable electric torch according to claim 1, wherein the optical transmission means comprise a colored filter.

4. The portable electric torch according to claim 1, wherein the optical transmission means comprise a lens.

5. The portable electric torch according to claim 1, wherein the optical transmission means are provided with a gripping finger at a top part and with a cylindrical protuberance at a bottom part constituting said swivel pin.

6. The portable electric torch according to claim 1, wherein the window of the housing remains open in said inactive position and is blanked off by the optical transmission means in the active position.

* * * * *